US008181464B2

(12) United States Patent
Wilbraham

(10) Patent No.: US 8,181,464 B2
(45) Date of Patent: May 22, 2012

(54) SWIRLER WITH CONCENTRIC FUEL AND AIR TUBES FOR A GAS TURBINE ENGINE

(75) Inventor: Nigel Wilbraham, Stourbridge (GB)

(73) Assignee: Siemens Aktiengesellschaft, München (DE)

( * ) Notice: Subject to any disclaimer, the term of this patent is extended or adjusted under 35 U.S.C. 154(b) by 575 days.

(21) Appl. No.: 12/310,143

(22) PCT Filed: Aug. 10, 2007

(86) PCT No.: PCT/EP2007/058321

§ 371 (c)(1),
(2), (4) Date: Feb. 12, 2009

(87) PCT Pub. No.: WO2008/019997

PCT Pub. Date: Feb. 21, 2008

(65) Prior Publication Data

US 2009/0277179 A1 Nov. 12, 2009

(30) Foreign Application Priority Data

Aug. 16, 2006 (EP) ..... 06017042

(51) Int. Cl.
*F02C 1/00* (2006.01)
*F02G 3/00* (2006.01)

(52) U.S. Cl. ..... 60/748; 60/740; 60/737; 60/776; 239/399

(58) Field of Classification Search ..... 60/748, 60/740, 742, 746, 737, 747, 776; 239/399
See application file for complete search history.

(56) References Cited

U.S. PATENT DOCUMENTS

| | | | | |
|---|---|---|---|---|
| 3,121,996 | A | 2/1964 | Smith | |
| 4,070,826 | A * | 1/1978 | Stenger et al. | 60/748 |
| 5,511,375 | A * | 4/1996 | Joshi et al. | 60/39.463 |
| 5,513,275 | A | 4/1996 | Joshi et al. | |
| 5,675,971 | A * | 10/1997 | Angel et al. | 60/746 |
| 2001/0052229 | A1 | 12/2001 | Tuthill et al. | |

FOREIGN PATENT DOCUMENTS

| | | | |
|---|---|---|---|
| EP | 1096201 | A1 | 5/2001 |
| EP | 1331441 | A1 | 7/2003 |

* cited by examiner

*Primary Examiner* — Ehud Gartenberg
*Assistant Examiner* — Carlos A Rivera

(57) ABSTRACT

A swirler passage is provided for mixing fuel and compressor air with at least two side walls; at least first and second conduits arranged inside at least one of the at least two side walls, the first conduit forming a fuel gas conduit and the second conduit forming an air conduit, the fuel gas conduit connected to a gas fuel supply and the air conduit connected to an air supply; a tube connected to the fuel gas conduit and entirely traversing the air conduit inside the side wall; a fluid passage connected to the air conduit and surrounding the tube; at least one fuel outlet opening of the tube arranged on the side wall; and at least one air outlet opening of the fluid passage arranged on the side wall and surrounding the fuel outlet opening.

16 Claims, 2 Drawing Sheets

SWIRLER WITH CONCENTRIC FUEL AND AIR TUBES FOR A GAS TURBINE ENGINE

CROSS REFERENCE TO RELATED APPLICATIONS

This application is the US National Stage of International Application No. PCT/EP2007/058321, filed Aug. 10, 2007 and claims the benefit thereof. The International Application claims the benefits of European Patent Office application No. 06017042.0 EP filed Aug. 16, 2006, both of the applications are incorporated by reference herein in their entirety.

FIELD OF THE INVENTION

The invention relates to a swirler passage and improvements for the further diminishment of air pollutants such as nitrogen oxides ($NO_x$).

BACKGROUND OF THE INVENTION

Air pollution is a worldwide concern and many countries have enacted stricter laws further limiting the emission of pollutants from gas turbine engines or offer fiscal or other benefits for environmentally sound installations. One method for reducing the emission of pollutants is thorough mixing of fuel and air prior to combustion which prevents high temperature stoichiometric fuel air mixtures in the combustor. Therefore the temperature dependent formation rate of $NO_x$ is lowered. Although the prior techniques for reducing the emissions of $NO_x$ from gas turbine engines are steps in the right direction, the need for additional improvements remains.

There are two main measures by which reduction of the temperature of the combustion flame can be achieved. The first is to use a fine distribution of fuel in the air, generating a fuel/air mixture with a low fuel fraction. The thermal mass of the excess air present in the reaction zone of a lean pre-mixed combustor absorbs heat and reduces the temperature rise of the products of combustion to a level where thermal $NO_x$ is not excessively formed. The second measure is to provide a thorough mixing of fuel and air prior to combustion. The better the mixing, the fewer regions exist where the fuel concentration is significantly higher than average, the fewer the regions reaching higher temperatures than average, the lower the fraction of thermal $NO_x$ will be.

Usually the premixing takes place by injecting fuel into an air stream in a swirling zone of a combustor which is located upstream from the combustion zone. The swirling produces a mixing of fuel and air before the mixture enters the combustion zone.

US 2001/0052229 A1 describes a burner with uniform fuel/air premixing. The premixer includes vanes that impart swirl to the airflow entering via the compressor air inlet openings. Each vane contains internal fuel flow tubes that introduce natural gas fuel into the air stream via fuel metering holes that pass through the walls of the vanes.

U.S. Pat. No. 5,511,375 describes an axial swirler having vanes containing internal concentric passages of flow exiting through holes near the trailing edge. The centre passage contains liquid fuel and the surrounding passage gaseous fuel. The arrangement is intended for a dual fuel burner.

SUMMARY OF THE INVENTION

An object of the invention is to provide a new swirler vane allowing for a better control of the pre-mixing of gaseous fuel and compressor air when operating over various machine loads and LCV/MCV fuels (low calorific value (LCV) fuels with low concentration of combustible components and medium calorific value (MCV) including fuels containing high levels of hydrogen and carbon monoxide) to provide a homogeneous fuel/air mixture and thereby reduce formation of $NO_x$.

This objective is achieved by the claims. The dependent claims describe advantageous developments and modifications of the invention.

An inventive swirler passage comprises a fuel injection system with a fuel outlet opening arranged in a side wall of the swirler passage for injecting fuel into a swirler passage. The fuel outlet opening is surrounded by an air outlet opening for controlled air supply, air creating a wake carrying the fuel into the swirler passage. Swirler passages are de-limited by first and second side faces of neighbouring swirler vanes, by the surface of a swirler vane support which is facing a burner head and by a surface of the burner head to which the swirler vanes are fixed. A swirler passage extends from a compressor air inlet opening to a mixture outlet opening positioned downstream from the compressor air inlet opening relative to the streaming direction of the compressed air.

By such a design of the fuel injection system a controlled placement of a mixture of fuel and compressor air in the swirler passage is obtained and an increased homogeneity or alternatively a tailoring of the mixture of fuel and compressor air for improved $NO_x$ emissions is enabled. For a given fuel opening the linear fuel momentum when entering the swirler passage depends on two parameters. The first parameter is machine load and hence overall fuel air ratio for the gas turbine. The design point of the machine is full load, where the momentum of the fuel is such that the fuel is placed in the centre of the swirler passage. At low load the momentum is reduced and the fuel sticks to the injection surface or the bottom of the swirler passage leading to a poor fuel/air-mixing. The second parameter is the fuel type. For the same machine load the amount of MCV fuel compared to the amount of LCV fuel is reduced. Accordingly, the fuel momentum at the fuel outlet opening is reduced, leading to a different placement in the swirler passage.

By surrounding the fuel tube with an air passage and by changing the air flow via a control unit a wake is created to overcome the variable fuel injection momentum when operating over various machine loads and LCV/MCV fuels and to always displace the fuel from the injection surface and to lift it off the floor/bottom of the swirler passage.

In a particular realisation of the swirler passage, concentric fuel and air outlet openings are arranged at an outer area of the swirler passage which adjoins the compressor air inlet opening. This allows for a long mixing path in the swirler passage.

It is particularly advantageous when the openings are arranged on the shorter side face of a swirler vane. The sharp air entry on the longer side face leads to flow recirculation and low pressure areas, drawing the fuel away from the shorter face.

The inventive swirler passage can be used in reversed operation, where air runs in the inner tube and fuel runs in the surrounding passage. The wake created with this configuration is not as strong as in the configuration where fuel is surrounded by air. Nevertheless, there is an improved placement of the fuel and the mixture of fuel and compressor air in the swirler passage compared to prior art.

BRIEF DESCRIPTION OF THE DRAWINGS

The invention will now be further described, with reference to the accompanying drawings in which.

Figure 1:
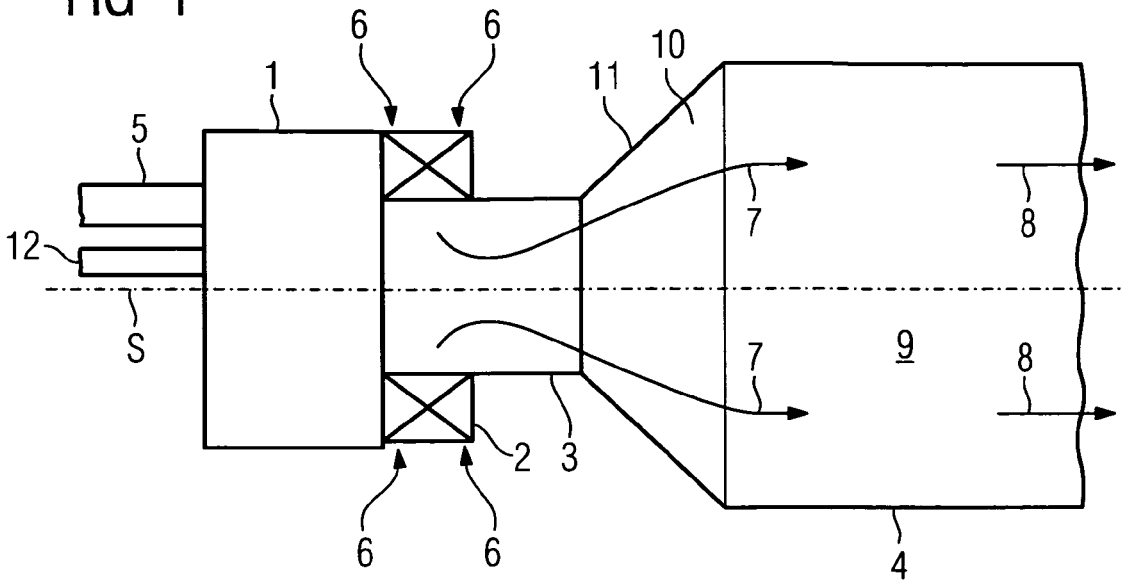
FIG. 1 shows a longitudinal section through a combustor.

In the drawings like references identify like or equivalent parts.

DETAILED DESCRIPTION OF THE INVENTION

FIG. 1 shows a longitudinal section through a combustor. The combustor comprises relative to a flow direction: a burner with swirler portion 2 and a burner-head portion 1 attached to the swirler portion 2, a transition piece referred to as combustion pre-chamber 3 and a main combustion chamber 4. The main combustion chamber 4 has a diameter being larger than the diameter of the pre-chamber 3. The main combustion chamber 4 is connected to the pre-chamber 3 via a dome portion 10 comprising a dome plate 11. In general, the transition piece 3 may be implemented as a one part continuation of the burner 1 towards the combustion chamber 4, as a one part continuation of the combustion chamber 4 towards the burner 1, or as a separate part between the burner 1 and the combustion chamber 4. The burner and the combustion chamber assembly show rotational symmetry about a longitudinally symmetry axis S.

A fuel supply 5 is provided for leading fuel to the burner which is to be mixed with inflowing air 29 in the swirler 2. An air supply 12 is provided for leading air to the swirler vane to carry the fuel into the swirler passage 24. The fuel/air mixture 7 is then guided towards the primary combustion zone 9 where it is burnt to form hot, pressurised exhaust gases 8 flowing in a direction indicated by arrows to a turbine of the gas turbine engine (not shown).

Figure 2:
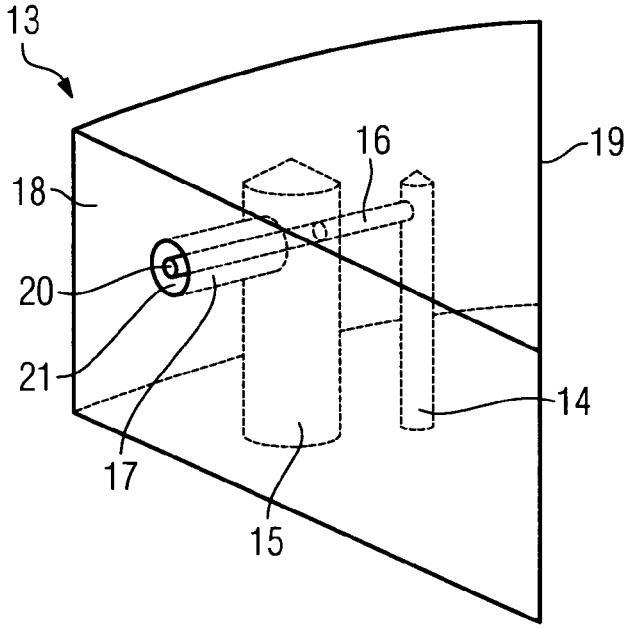
FIG. 2 is a representation of a swirler vane according to the invention.

With reference to FIG. 2 a swirler vane 13 comprises first and second conduits 14,15, the first conduit forming a fuel gas conduit 14 and the second conduit forming and an air conduit 15, the fuel gas conduit 14 connected to a gas fuel supply (not shown) and the air conduit 15 connected to an air supply (not shown). A tube 16 is in communication with the fuel gas conduit 14 and traverses entirely the air conduit 15 inside the swirler vane 13. A fluid passage 17 is in communication with the air conduit 15. A diameter of the fluid passage 17 is larger than a diameter of the tube 16. Tube 16 and fluid passage 17 have an essentially coaxial arrangement for obtaining an essentially concentric flow of fuel and air inside the swirler vane 13. On the first side face 18 of the swirler vane 13 a fuel outlet opening 20 of the tube 16 is arranged, surrounded by an air outlet opening 21 of the fluid passage 17.

Figure 3:
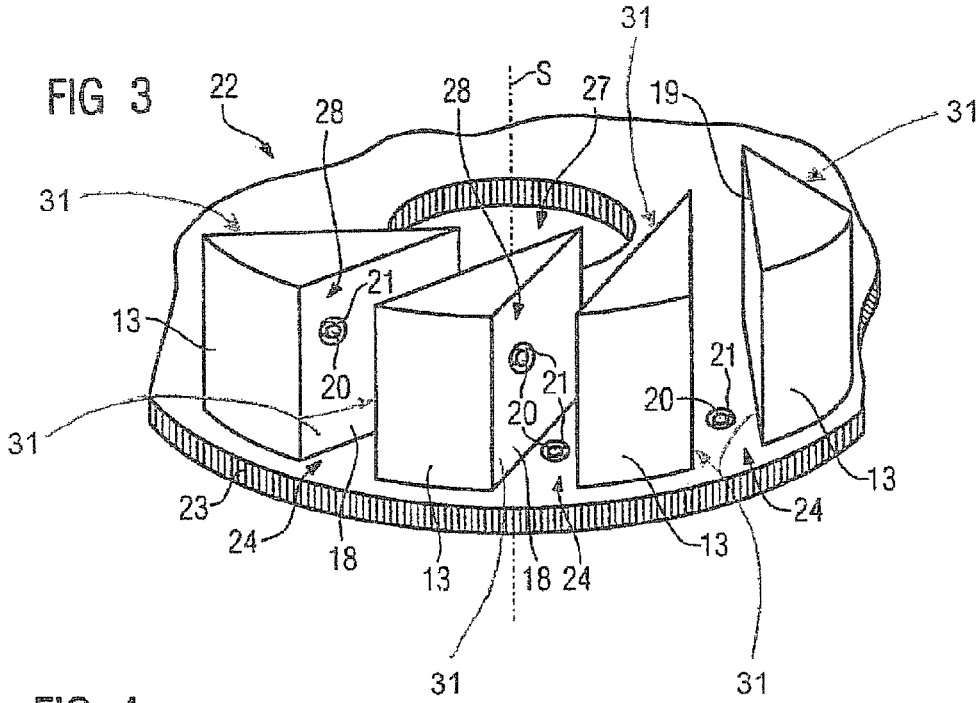
FIG. 3 shows a perspective view of the inventive swirler passages arranged on a swirler vane support.

With reference to FIG. 3 a swirler assembly 22 comprises a plurality of swirler vanes 13 disposed about a central axis S being arranged on a swirler vane support 23 with a central opening 27. Neighbouring swirler vanes 13 form swirler passages 24. Fuel and air outlet openings 20,21 are arranged on first side faces 18 of swirler vanes 13 and on the swirler vane support 23.

Figure 4:
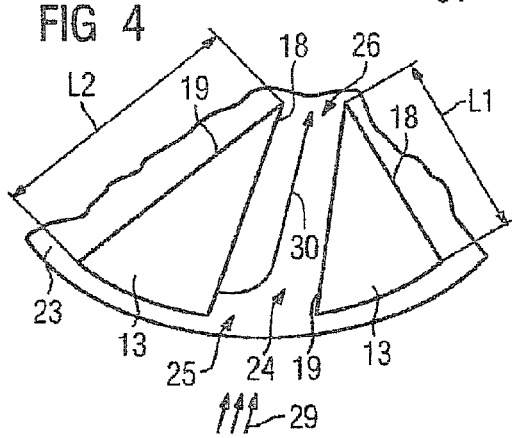
FIG. 4 shows a partial top view of a swirler operated at the design point.

With reference to FIG. 4 a swirler passage 24 extends between a compressor air inlet opening 25 and a mixture outlet opening 26. Swirler passages 24 are delimited by first and second side faces 18,19 of neighbouring swirler vanes 13, by the surface of the swirler vane support 23 which faces the burner head 1 (not shown in this figure) and by a surface of the burner head 1 to which the swirler vanes 13 are fixed. Along these swirler passages 24 compressed air generally flows radially inwardly, as indicated by the arrows 29, from an plenum (not shown) supplied with air by the compressor of the gas turbine engine. On leaving the swirler passages 24 the combustion air enters the pre-chamber 3 (not shown) adjacent to an upstream end thereof. Fuel 30 is added through a fuel outlet opening 20 in the first side face 18 of a swirler vane 13. When the machine runs at the design point, which is typically full load, the fuel momentum is such that the fuel 30 is carried into the centre of the compressed air flow in the swirler passage 24.

Figure 5:
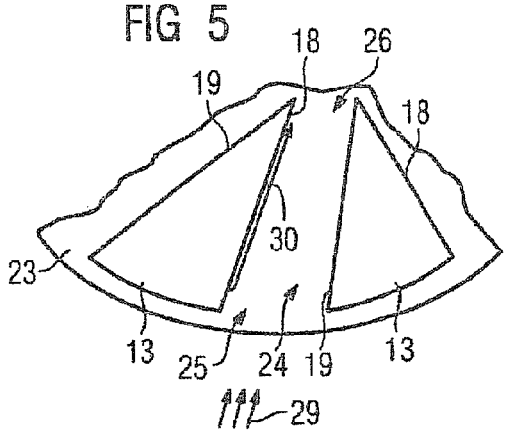
FIG. 5 shows a partial top view of a swirler at reduced machine load and/or with MCV fuel.

With reference to FIG. 5 the fuel momentum is, for a given opening diameter of the fuel outlet opening 20, not sufficient when the machine load is reduced, or a fuel with higher calorific value is used. Fuel 30 then remains close to the injection surface of the first side face 18 and the bottom of the swirler passage 24 and the mixing with compressed air is poor.

Auxiliary air creates a wake and carries fuel 30 into the swirler passage 24 overcoming the variable fuel injection momentum ratio when operating over various machine loads and MCV/LCV fuels.

The operation of the fuel gas conduit 14 and the air conduit 15 can be reversed, so that air is injected through the tube 16 instead of the fluid passage 17 and fuel is injected through the fluid passage 17 instead of the tube 16.

Not only the location of the fuel outlet opening (20) and the air outlet opening (21) can vary but also the number of pairs of fuel outlet openings (20) and air outlet openings (21).

The fuel outlet openings (20) and the air outlet openings (21) in the described embodiments are located in the first side faces (18) of the swirler vanes (13) and/or on the swirler vane support (23). However, it is also possible to arrange fuel outlet openings (20) and air outlet openings (21) on the second side faces (19) of the swirler vanes (13). Obviously fuel and air outlet openings (20, 21) can be arranged on any passage side wall (31) and any combination of side walls (31) is possible.

Even if the embodiment of FIG. 2 shows coaxial tube 16 and fluid passage 17 with concentric circular openings 20,21 at their ends, variations can be envisioned where the route of tube 16 and fluid passage 17 inside the swirler vane 13 is not strictly straight, coaxial or parallel. In a further development of the invention the fuel outlet opening 20 and air outlet opening 21 could be designed slightly off-centre and non-circular. All those embodiments shall also be included in the features "essentially coaxial" respectively "essentially concentric" of the independent claims.

REFERENCE NUMERAL LIST

1 burner head
2 swirler
3 pre-chamber
4 main chamber
5 fuel supply
6 compressor air
7 fuel/air mixture
8 exhaust gas
9 combustion zone
10 dome portion
11 dome plate
12 air supply
13 swirler vane
14 fuel gas conduit
15 air conduit
16 tube
17 fluid passage

18 first side face
19 second side face
20 fuel outlet opening
21 air outlet opening
22 swirler assembly
23 swirler vane support
24 swirler passage
25 compressor air inlet opening
26 mixture outlet opening
27 central opening
28 outer area
29 inflowing air
30 fuel
31 side wall

What is claimed is:

1. A swirler passage for mixing fuel and compressor air, comprising:

a first swirler vane having a first side wall and a second swirler vane having a second side wall, wherein the first and second side walls are separated by a pathway;

a support surface for supporting the first and second side walls;

a first conduit and second conduit arranged inside at least one of the plurality of side walls, the first conduit forming a fuel gas conduit and the second conduit forming an air conduit, the fuel gas conduit connected to a gas fuel supply and the air conduit connected to an air supply;

a tube connected to the fuel gas conduit and entirely traversing the air conduit;

a fluid passage connected to the air conduit and surrounding the tube;

a first fuel outlet opening of the tube arranged on the first side wall;

a first air outlet opening of the fluid passage arranged on the first side wall and surrounding the first fuel outlet opening;

a second fuel outlet opening located on the support surface between the first and second side walls wherein the second fuel outlet opening is coupled to the gas fuel supply; and a second air outlet opening located on the support surface between the first and second side walls and surrounding the second fuel outlet opening wherein the second air outlet opening is coupled to the air supply and wherein fuel from the first and second fuel outlet openings and air from the first and second air outlet openings is introduced into the pathway between the first and second swirler vanes.

2. The swirler passage as claimed in claim 1, wherein the fluid passage is tube-shaped.

3. The swirler passage as claimed in claim 2, wherein a diameter of the fluid passage is larger than a diameter of the tube.

4. The swirler passage as claimed in claim 3, wherein the tube and the fluid passage have an essentially coaxial arrangement for obtaining an essentially concentric flow of fuel and air inside the side wall.

5. The swirler passage as claimed in claim 1, wherein each of the plurality of side walls is a side face of a swirler vane.

6. The swirler passage as claimed in claim 5, wherein a pair of openings including the fuel outlet opening and the air outlet opening is arranged in an outer area of the first side face.

7. The swirler passage as claimed in claim 5, wherein the first side face has a smaller length than a second side face.

8. The swirler passage as claimed in claim 6, wherein a first of the side faces has a smaller length than a second side face of the swirler vane.

9. A burner, comprising a swirler passage as claimed in claim 1.

10. A swirler vane apparatus, comprising:

a first conduit and second conduit each arranged inside a first swirler vane, the first conduit forming a fuel gas conduit and the second conduit forming an air conduit, the fuel gas conduit connected to a gas fuel supply and the air conduit connected to an air supply;

a tube connected to the fuel gas conduit and entirely traversing the air conduit inside the first swirler vane;

a fluid passage connected to the air conduit and surrounding the tube;

a first fuel outlet opening of the tube arranged on a first side face of the swirler vane;

a first air outlet opening of the fluid passage arranged on the first side face of the swirler vane and surrounding the first fuel outlet opening:

a second swirler vane separated from the first swirler vane by a pathway:

a support surface for supporting the first and second swirler vanes;

a second fuel outlet opening located on the support surface adjacent the first side face wherein the second fuel outlet opening is coupled to the gas fuel supply; and a second air outlet opening located on the support surface adjacent the first side face and surrounding the second fuel outlet opening wherein the second air outlet opening is coupled to the air supply wherein fuel from the first and second fuel outlet openings and air from the first and second air outlet openings is introduced into the pathway between the first and second swirler vanes.

11. The swirler vane as claimed in claim 10, wherein the fluid passage is tube-shaped.

12. The swirler vane as claimed in claim 11, wherein a diameter of the fluid passage is larger than a diameter of the tube.

13. The swirler vane as claimed in claim 12, wherein the tube and the fluid passage have an essentially coaxial arrangement for obtaining an essentially concentric flow of fuel and air inside the swirler vane.

14. The swirler vane as claimed in claim 10, wherein one pair of openings including the fuel outlet opening and the air outlet opening is arranged in an outer area of the first side face.

15. The swirler vane as claimed in claim 10, wherein the first side face has a smaller length than a second side face of the swirler vane.

16. A method of operating a burner, comprising:

providing a burner comprising a swirler passage, the swirler passage comprising:

a plurality of side walls including a first side wall of a first swirler vane and a second side wall of a second swirler vane wherein the first and second side walls are separated by a pathway, a support surface for supporting the first and second side walls, a first conduit and second conduit arranged inside at least one of the plurality of side walls, the first conduit forming a fuel gas conduit and the second conduit forming an air conduit, the fuel gas conduit connected to a gas fuel supply and the air conduit connected to an air supply, a tube connected to the fuel gas conduit and entirely traversing the air conduit, a fluid passage connected to the air conduit and surrounding the tube, a first fuel outlet opening of the tube arranged on the first side wall, and a first air outlet opening of the fluid passage arranged on the first side wall and surrounding the first fuel outlet opening;

a second fuel outlet opening located on the support surface between the first and second side walls wherein the second fuel outlet opening is coupled to the gas fuel supply;

a second air outlet opening located on the support surface between the first and second side walls and surrounding the second fuel outlet opening wherein the second air outlet opening is coupled to the air supply;

injecting gaseous fuel into the fuel gas conduit;

injecting auxiliary air into the air conduit for carrying the gaseous fuel into the pathway between the first and second swirler vanes;

mixing the gaseous fuel and compressor air injected into the pathway between the first and second swirler vanes for generating a mixture of gaseous fuel and compressor air; and injecting the mixture into a combustion zone.

* * * * *